United States Patent [19]

Hoyt, Jr.

[11] 4,091,790

[45] May 30, 1978

[54] TAKE DOWN BOW WITH LIMB ADJUSTMENT MEANS

[76] Inventor: Earl H. Hoyt, Jr., 11510 Natural Bridge Rd., Bridgeton, Mo. 63044

[21] Appl. No.: 769,010

[22] Filed: Feb. 16, 1977

[51] Int. Cl.[2] ..... F41B 5/00

[52] U.S. Cl. ..... 124/24 R; 124/88; 124/89

[58] Field of Search ..... 124/23 R, 24 R, 26, 124/21, 22, 41 A, 86, 88, 25

[56] References Cited

U.S. PATENT DOCUMENTS

| | | | |
|---|---|---|---|
| 3,207,146 | 9/1965 | Grable | 124/24 R |
| 3,989,026 | 11/1976 | Nishiora | 124/24 R |

*Primary Examiner*—William R. Browne
*Attorney, Agent, or Firm*—Charles E. Markham

[57] ABSTRACT

The handle section of a take down bow has a socket at each end loosely receiving the butt ends of upper and lower bow limbs arranged to pivot both fore and aft and laterally on outer end portions of the rear socket walls; adjusting screws extending through inner end portions of the forward socket walls engage the forward faces of the bow limbs to variably tilt them fore and aft in the plane including the low and the bow string, and camming members rotatably mounted in inner end portions of the rear socket walls have eccentric portions extending into and engaging laterally opposed surfaces of notches in the ends of the bow limbs to variably pivot the limbs laterally.

9 Claims, 12 Drawing Figures

TAKE DOWN BOW WITH LIMB ADJUSTMENT MEANS

This invention relates to take down archery bows having removable bow limbs entered into sockets or reentries having forward and rear walls in the ends of a handle section and particularly to means for angularly adjusting the bow limbs both fore and aft and laterally with respect to the handle section.

Some currently manufactured bows include means for the independent angular adjustment of the bow limbs forward and rearward with respect to the handle section. This provision not only enables an archer to increase or decrease the total force required to draw the bow a given amount, it also provides a means for fine tuning a bow. By individually adjusting the bow limbs angularly in a forward or rearward direction so as to increase or decrease stress differential in the limbs, an archer may compensate for his or her particular manner of gripping a bow affecting differential in limb stress when the bow is drawn.

Conventionally, the removable bow limbs of take down bows are held against lateral angular or translational movement in a handle section either by closely fitting the limb butt ends between the side walls of sockets in the handle section or by closely fitting longitudinally spaced or longitudinally extending cooperating elements on the limb butt portions and the handle section. In any event the limbs of prior take down bows were fixed against lateral angular or translational movement.

It has, however, been found desirable for several reasons to provide means for the lateral angular adjustment of the limbs about the ends of the handle section in modern bows so that the longitudinal center lines of the limbs may be either precisely aligned with the bow string and longitudinal center line of the handle section or slightly tilted laterally so that the bow string lies to one side or the other of the longitudinal center line of the handle section.

One advantage of this provision is that in the manufacture of take down bows, wherein the lateral alignment of the bow limbs is fixed, very close manufacturing tolerances must be held in order that limb alignment will be precisely what it is intended to be. With the provision of means for lateral angular limb adjustment relatively wide manufacturing tolerances are permissible while precise alignment of the limbs is readily achieved.

Secondly, this provision permits compensatory limb adjustment to reduce the effect of any twisting force inadvertently and consistantly applied to the bow handle in one direction or the other as a result of an archer's particular manner of gripping the bow as it is drawn. Angularly adjusting or tilting the bow limbs laterally so that a bow string attached to their limbs lies to one side of the longitudinal center line of the handle section when the bow is braced will compensate for the effect upon arrow flight of a torsional force applied to the handle section tending to move the bow string toward the opposite side of the handle section as the bow is drawn.

A third and important advantage of this provision is that the limbs may be tilted laterally so as to cause the rear fletched end of an arrow to be swung outward just sufficiently to insure clearance of the fletching as it passes the bow handle when released.

Accordingly, an object of this invention is to provide a generally new and improved archery bow in which the inner ends of the bow limbs are mounted on an intermediate handle section for lateral angular adjustment.

A further object is to provide an archery bow having the inner ends of the bow limbs pivoted at opposite ends of a handle section and means movably mounted in opposite ends of the handle section engaging opposite lateral sides of the bow limbs for rotating the limbs laterally to various adjusted positions.

A further object is to provide an archery bow having means mounting the bow limbs at the ends of an intermediate handle section for angular adjustment both laterally and fore and aft with respect to the handle section.

Further objects and advantages will appear from the following description when read in connection with the accompanying drawing.

Figures 1, 2, 3, 4, 5, 6, 7, 8, 9, 10, 11, 12:
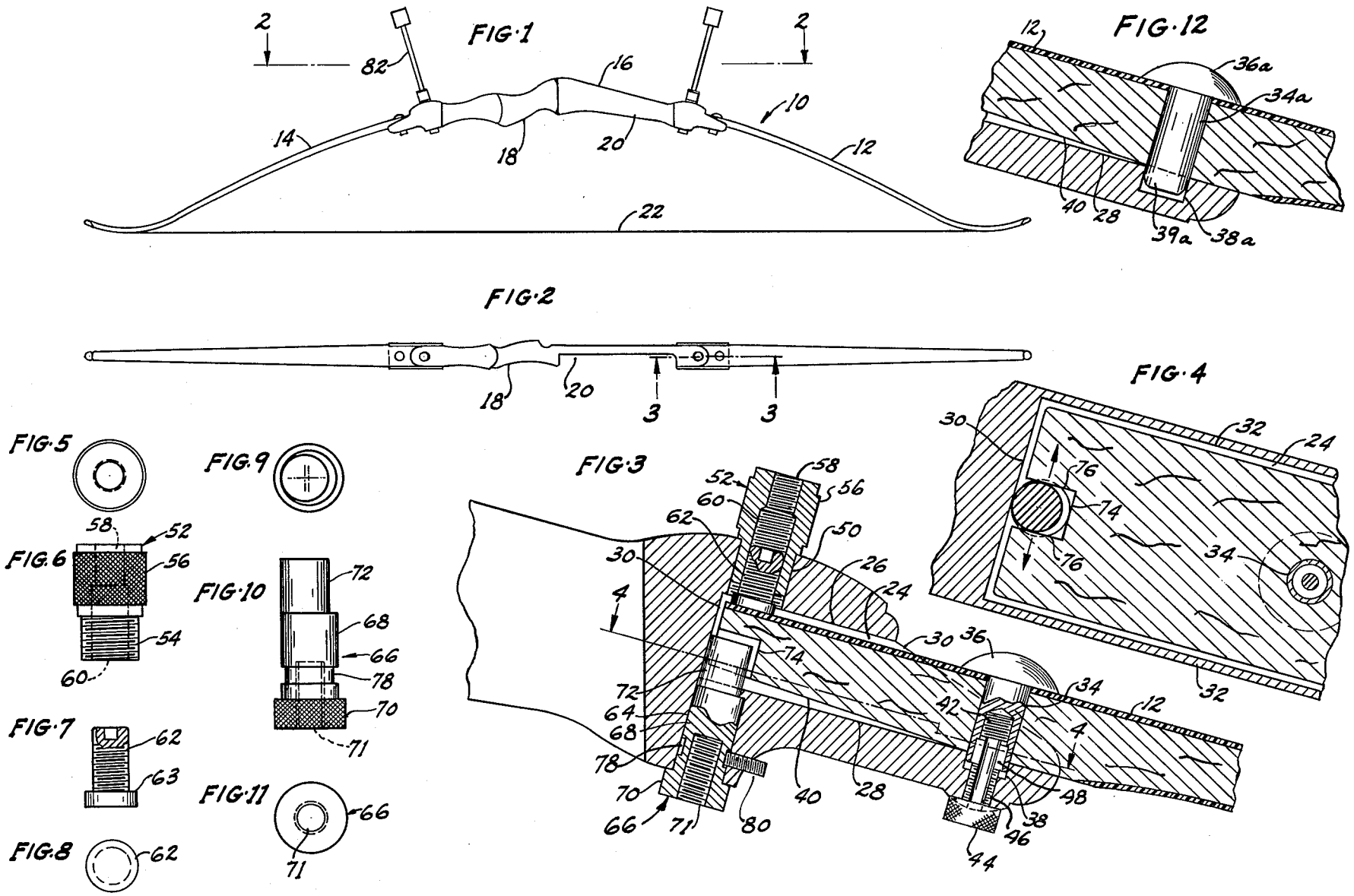
FIG. 1 is a side elevational view of a take down bow constructed in accordance with the present invention.
FIG. 2 is a front elevational view looking along line 2—2 of FIG. 1.
FIG. 3 is an enlarged fragmentary cross sectional view taken along line 3—3 of FIG. 2.
FIG. 4 is a fragmentary cross sectional view taken along line 4—4 of FIG. 3.
FIGS. 5 and 6 are outer end and side elevational views respectively of the externally and internally screw threaded ferrule.
FIGS. 7 and 8 are outer end and side elevational views respectively of the screw threaded limb adjusting member.
FIGS. 9, 10 and 11 are an inner end view, a side elevational view and an outer end view respectively of the eccentric limb adjusting member.
FIG. 12 is an enlarged detail view of a modified form of the limb pivot pin and blind bore that receives it.

Referring to the drawings in more detail, a take down bow generally indicated at 10 has an upper limb 12, a lower limb 14 and an intermediate handle section 16. The handle section has a grip portion 18 and a sight window 20. A bow string 22 attached to the limb ends holds the bow in a braced condition.

The handle section 16 has a socket 24 of rectangular cross section extending inwardly at each end thereof defined by a relatively short forward wall 26, a relatively long rear wall 28, a bottom wall 30 and side walls 32. The bow limbs 12 and 14 are flat and rectangular in cross section and have their butt end portions loosely entered into sockets 24 with the sides, the ends and the forward surfaces thereof spaced respectively from the side, bottom and forward walls of sockets 24.

Centrally positioned pins 34 having large heads 36 extend through the limb butt portions at a point spaced from the limb ends and enter counterbores. 38. Counterbores 38 are centrally positioned in the rear socket walls 28 and are spaced outwardly from the bottom socket walls 30. The bow limbs are thus pivoted for limited lateral angular movement. The rear surfaces of the limb butt portions slope inward toward their forward surfaces from the centers of pivot pins 34 to the inner ends of the limbs, as indicated at 40. The limbs may therefore be rocked forward and rearward a limited amount between the position shown in FIG. 3 to a position in which the sloped rear surfaces 40 lie continuous with the rear socket walls 28.

The pins 34 are fixed in the bow limbs and their projecting ends are rounded and extend into the counterbores 38 just sufficiently to maintain limb position against lateral or longitudinal translational movement while at the same time permitting limited forward and rearward angular limb movement. The pins 34 have longitudinal screw threaded bores 42 therein which receive the enlarged screw threaded end portions of knurled headed screws 44 which are entered through screw threaded bores 46 in the rear socket walls concentric with counterbores 38. The projecting ends of pins 34 are further provided with clearance counterbores 48 which permit the removal of pins 34 from counterbore 38 when screws 44 are disengaged from threaded portion 42. The enlarged threaded end portions of screws 44 are retained in the counterbores 38 in the rear socket walls when they are threadedly disengaged from the screw threaded bores 42 to disassemble the bow limbs.

Threadedly engaged in a screw threaded bore 50 extending through the forward wall 26 adjacent the bottom wall 30 of sockets 24 is a ferrule 52.

Ferrules 52 each have an exterior screw threaded portion 54 engaged in the screw threaded bore 50 and a knurled head 56 extending exteriorly from the forward socket wall 26. Ferrules 52 are each further provided with a relatively small diameter screw threaded bore 58 extending inward from its head end and a relatively large diameter screw threaded bore 60 extending inward from its inner end. A screw 62 threadedly engaged in the larger diameter bore 60 of each ferrule has a cylindrical head 63 at one end in engagement with the forward surface of a bow limb near its inner end. At their opposite ends screws 62 are provided with hexagonal sockets for receiving an Allen wrench. As the screws 62 are rotated when the bow is braced the limbs are rocked angularly forward and rearward about transverse lines extending across the inner surfaces of rear socket walls 28 and passing through the centers of pins 34.

Mounted for rotation in a smooth bore 64 extending through the rear wall 28 of each of the sockets 24 adjacent the socket bottoms is a rotary cam member 66. Member 66 has a cylindrical portion 68 closely fitted for rotation in the bore 64, a knurled head 70 at the exterior end thereof and a cylindrical portion 72 at the inner end of cylindrical portion 68 which is eccentric with respect to cylindrical portion 68. The eccentric cylindrical portion 72 of each of the cam members 66 is entered into a notch 74 centrally positioned in the end of each of the bow limbs. Notches 74 have longitudinally extending parallel opposed surfaces 76 which are in contact with diametrically opposed surfaces of the eccentric cylindrical portions 68. When the cam members 66 are rotated the bow limbs are moved angularly about the centers of pins 34.

The cylindrical portions 68 of the cam members 66 have annular flat bottomed grooves 78 therein which receive the forward ends of headless Allen set screws 80. When set screws 80 are screwed inward tightly to prevent rotation of cam members 66 the bow limbs are held fixed in an adjusted position. Cam members 66 are further provided with longitudinal screw threaded bores 71 for a purpose to be described.

The screws 44 entered into pins 34 are for the purpose of preventing inadvertent disassembly of the bow limbs from the handle section when the bow is unstrung or not braced. When the bow is braced or when the bow is drawn and released to a braced position under shooting conditions the bow limbs will remain in assembled and adjusted position without the screws 44. In view of this a modified form of the pin 34 is shown in FIG. 12. Referring to FIG. 12, a pin **34*a* having a large head 36*a* is substituted for pin 34 in FIG. 3. Pin 34*a* is fixed in the bow limb and has a hemispherical end 39*a* entered into a counterbore 38*a* in the rear wall of the socket 24** substantially to the center of curvature of its hemispherical end.

The smaller diameter screw threaded bores 58 in ferrules 52 and the longitudinal screw threaded bores 71 in cam members 66 are provided for the screw threaded attachment of stabilizing elements as indicated at 82 in FIG. 1.

The foregoing description and drawings are intended to be illustrative not limiting, the scope of the invention being set forth in the appended claims.

I claim:

1. In an archery bow, a handle section, upper and lower bow limbs and a bow string, means for pivoting the butt end portions of said limbs on the ends of said handle section in a plane substantially in the plane including said bow limbs and bow string permitting for angular movement of said limbs lateral to the plane including the low and the bow string, and means rotatably mounted in said handle section near each end thereof and spaced longitudinally inward from said pivoting means for engaging laterally opposed surfaces of the terminal end portions of the butt ends of said bow limbs for selectively angularly adjusting said limbs a plane generally perpendicular to the plane of the bow and bow string and for holding them in the angularly adjusted positions.

2. The bow claimed in claim 1 in which said means adjustably mounted on said handle section comprises a cam member rotatably mounted in said handle section near each end thereof and spaced inward from said pivoting means, said cam members each including a cylindrical cam surface in engagement with laterally opposed surfaces on each said limb, and means for releasably locking said cam members against rotation.

3. In a take down archery bow, a handle section having spaced front and rear walls extending longitudinally from each end thereof receiving the butt end portions of upper and lower flat bow limbs therebetween, means pivoting said limbs on said rear walls near the outer ends thereof for lateral angular limb movement, said pivoting means comprising a short projection on each of said limbs entered into a bore in each of said longitudinally extending rear walls, and a member rotatably mounted in each end of said handle section and spaced longitudinally inward from said pivot means for angularly moving said bow limbs laterally, said rotatably mounted members each including an eccentric cylindrical surface in engagement with laterally opposed surfaces on said bow limbs, and means for locking said rotatably mounted members against rotation.

4. The bow claimed in claim 3 in which said pivoting means comprises a hemispherical projection on each of said bow limbs entered into a bore in each of said rear walls.

5. The bow claimed in claim 3 in which said front and rear walls are spaced sufficiently to permit limited fore and aft angular movement of said bow limbs, and in which a screw threaded member threadedly engaged in and extending through said forward wall at each end of said handle section and spaced inward from said pivoting means engages the forward face of each bow limb, whereby the limbs are caused to rock forwardly or rearwardly when in braced condition as said screw threaded members are screwed inward or inward.

6. The bow claimed in claim 3 which includes side walls connecting said front and rear walls, and the spacing of said side walls being sufficiently greater than the width of said bow limbs to permit substantial lateral angular limb movement.

7. The bow claimed in claim 5 in which said front walls are sufficiently shorter than said rear walls to permit tilting the bow limbs forward enough to freely enter said short projections on said limbs into said bores when assembling the limbs to the handle section and to freely disengage them when disassembling the limbs.

8. In a take down archery bow, a handle section having a socket in each end thereof defined by longitudinally extending parallel front and rear walls, parallel side walls and a botton wall, said sockets loosely receiving the flat butt ends of bow limbs, means pivoting said limb butt portions on said rear walls of each socket near the outer ends of said sockets for limited lateral rotation and for limited fore and aft rotation, said pivoting means comprising a cylindrical member fixed to each limb butt portion and having a hemispherical end portion projecting from the rear surface of each limb butt portion entered into a bore in the rear wall of each socket, means rotatably mounted in each end of said handle section near the bottom socket wall engaging laterally opposed surfaces of said bow limbs near their inner ends to rotate said limbs laterally, screw threaded means threadedly engaged in and extending inward through said front socket walls engaging the front faces of said limb butt portions near their inner ends to cause said limbs to rotate fore and aft when said limbs are in a braced condition as said screw threaded members are screwed outward and inward, and means for releasably locking said rotatably mounted means against rotation.

9. The archery bow claimed in claim 8 in which said means rotatably mounted in each end of said handle section near the bottom of said socket wall comprises a cylindrical member mounted for rotation in each of said rear socket walls, each of which members has an eccentric cylindrical portion in engagement with laterally opposed surfaces of a notch in the inner end of each bow limb, and means for releasably locking said cylindrical members against rotation.

* * * * *